United States Patent [19]

Ford et al.

[11] Patent Number: 4,919,319

[45] Date of Patent: Apr. 24, 1990

[54] CONTACTLESS WEB SUPPORT GUIDE

[76] Inventors: John W. Ford, 54 Chesham Rd., Kingston Upon Thames, Surrey, England, KT1 3AQ; Maurice J. Dyer, 3 Sylvan Ave., Mill Hill, London, England, N.W. 7

[21] Appl. No.: 327,139

[22] Filed: Mar. 22, 1989

Related U.S. Application Data

[63] Continuation-in-part of Ser. No. 58,279, Jun. 4, 1987, Pat. No. 4,824,002.

[30] Foreign Application Priority Data

| | | | |
|---|---|---|---|
| Jun. 6, 1986 | [GB] | United Kingdom | 8613764 |
| May 1, 1987 | [GB] | United Kingdom | 8710433 |
| May 25, 1988 | [GB] | United Kingdom | 8807170 |

[51] Int. Cl.[5] ..... B65H 23/24

[52] U.S. Cl. ..... 226/197; 226/97

[58] Field of Search ..... 226/97, 197; 34/156

[56] References Cited

U.S. PATENT DOCUMENTS

| | | | |
|---|---|---|---|
| 3,313,462 | 4/1967 | Smith | 226/97 |
| 3,984,039 | 10/1976 | Hawley | 226/97 |
| 4,182,472 | 1/1980 | Peekna | 226/97 |
| 4,197,972 | 4/1980 | Daane | 226/197 X |
| 4,342,413 | 8/1982 | Reba | 226/197 X |

*Primary Examiner*—Donald Watkins

*Attorney, Agent, or Firm*—Burns, Doane, Swecker & Mathis

[57] ABSTRACT

Contactless support guides serve to create a cushion of pressurized air to hold a web of material such as paper spaced from a support face. The support face can be curved to transport the web through an angular deviation. The support face contains a large number of shallow pockets at least some of which emit air to create the cushion. Special additional pockets or slats are provided to create zones of higher pressure in the regions of the cushion where the web enters and exits the guide.

9 Claims, 5 Drawing Sheets

CONTACTLESS WEB SUPPORT GUIDE

CROSS REFERENCE TO RELATED APPLICATIONS

This application is a continuation-in-part of U.S. Pat. application Ser. No. 058,279 filed June 4th 1987, now U.S. Pat. No. 4,824,002.

FIELD OF THE INVENTION

This invention relates to a contactless support guide for a web of material.

BACKGROUND TO THE INVENTION

Contactless web support guides are incorporated in printing machines, usually when it is required to print both sides of a web of material without intermediate drying between the two printing processes. In effect, they are air bearing devices which replace specific rollers of the printing machine, thereby preventing smudging. Typically, such support guides are used to change the direction of motion of a web (usually through 90°), in which case they are referred to as "air turns". Air turns are usually used in pairs to reverse the direction of motion of a web. Similar support guides (known as "air bars") are used to support and guide webs without changing their direction of motion.

There are two main problems which a successful contactless support guide must overcome. Firstly, the air pressure between the underside of the web and the support face must be even, and as low as possible consistent with the keeping of a layer of air between the two surfaces, even though the web tension varies and the escape of air at the web entry and exit regions of the support face causes a reduction in pressure at these regions. Any unevenness of air pressure will tend to cause ballooning out of the web, which leads to instability and possibly bursting. Secondly, it is essential that the contactless support guide maintains lateral stability of the web, whilst preventing the web from touching the support face. The constant demand for ever increasing outputs, with the resulting increased web speeds, has led to longer unsupported web runs in the latest machines, particularly in their drying units. Known contactless support guides are inadequate in this respect. They are also extremely noisy.

The aim of the invention is to provide a contactless support guide which maintains the stability of the web at high speeds, and is quieter than known devices.

SUMMARY OF THE INVENTION

The present invention provides a contactless support guide for guiding a moving web of material; said guide comprising means defining an arcuate support face for controlling the moving web; a multiplicity of first pockets in the support face, the first pockets being distributed over the support face to substantially fill the face; further elongate pockets provided in the support face at marginal regions where the web enters and exits the guide; a plurality of closely spaced apertures in each of the further pockets for emitting air; and air supply means, including a manifold, for receiving pressurized air and for supplying said air to the apertures of the further pockets to create an air cushion extending around the support face to support the moving web in a generally uniform spaced relationship relative to the support face; wherein the further pockets and the apertures therein are angled towards the first pockets and zones of higher pressure are produced in the air cushion at said marginal regions where the web enters and exits the guide.

Apertures can also be provided in at least some of the first pockets but these apertures are best made smaller than those of the further pockets. The apertures of the pockets in the region of the support face which is central with respect to the direction of movement of a web over the support face can be smaller than the inlet apertures of the pockets at the web entry and exit regions of the support face. Preferably, the inlet apertures of the pockets in said central region have a diameter of 1/16th inch, the inlet apertures of the pockets in said entry and exit regions have a diameter of ¼ inch, the diameters of the inlet apertures being graded from said central region to the entry and exit regions.

In preferred embodiments, a plenum chamber is positioned between the manifold and the support face and the air inlet apertures of the pockets can lead to the plenum chamber.

Conveniently, the guide further comprises an air distribution baffle positioned in the plenum chamber in the air flow path from the manifold to the support face. Preferably, the baffle is formed with a plurality of apertures.

Advantageously, the pockets are arranged in rows which extend at right-angles to the direction of movement of a web over the support face.

In one construction, the guide comprises means defining an arcuate support face for controlling the moving web; a multiplicity of first pockets in the support face, the first pockets being distributed over the support face to substantially fill the face; second elongate pockets or groups of pockets provided in the support face at marginal regions where the web enters and exits the guide; a plurality of closely spaced apertures in each of the second pockets for emitting air; at least one further blind pocket disposed between one of the second pockets or groups of pockets and an adjacent edge of the support face and air supply means, including a manifold, for receiving pressurized air and for supplying said air to the apertures in the second pockets to create an air cushion extending around the support face to support the moving web in a generally uniform spaced relationship relative to the support face; wherein the second pockets and apertures therein are angled towards the first pockets. The second pockets and their inlet apertures can be angled towards the centre of the support face, with the second pockets and their inlet apertures constituting means for increasing the air pressure at the web entry and exit regions. Advantageously, each of the second pockets is elongated with a width of ⅜ inch and a maximum depth of ⅜ inch, and the inlet apertures each have a diameter of 3/16 inch and are spaced apart by ¼ inch. Preferably, each of the first pockets is circular, having a diameter of 1 inch and a depth of ⅜ inch.

In another construction, slats are positioned at end regions of the support face where the web enters and exits the guide, the slats being disposed relative to the support face to control the air flow and the cushion to increase the tendency of the latter to lift the web away from the support face at the web entry and exit regions.

Advantageously, the support face is of such dimensions as to support and guide a web for movement through an angle of substantially 90°. Alternatively, the support face is gently curved so as to support and guide a web moving generally rectilinearly.

BRIEF DESCRIPTION OF THE DRAWINGS

Various forms of contactless web support guide, each of which is constructed in accordance with the invention, will now be described, by way of example, with reference to the accompanying drawings, in which.

DESCRIPTION OF PREFERRED EMBODIMENTS

Figure 1:
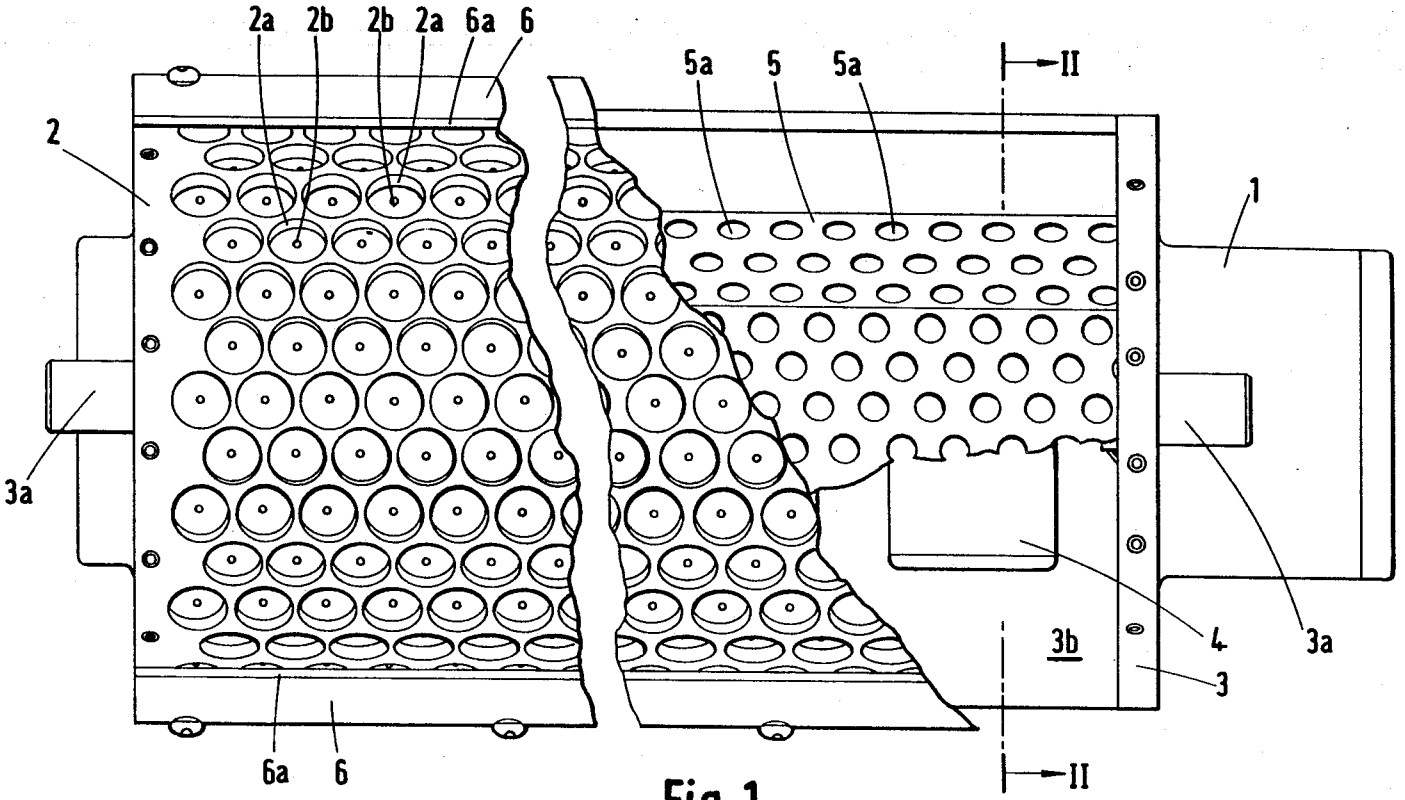
FIG. 1 is a side elevation, partially broken away, of the first form of contactless support guide.
Figure 2:
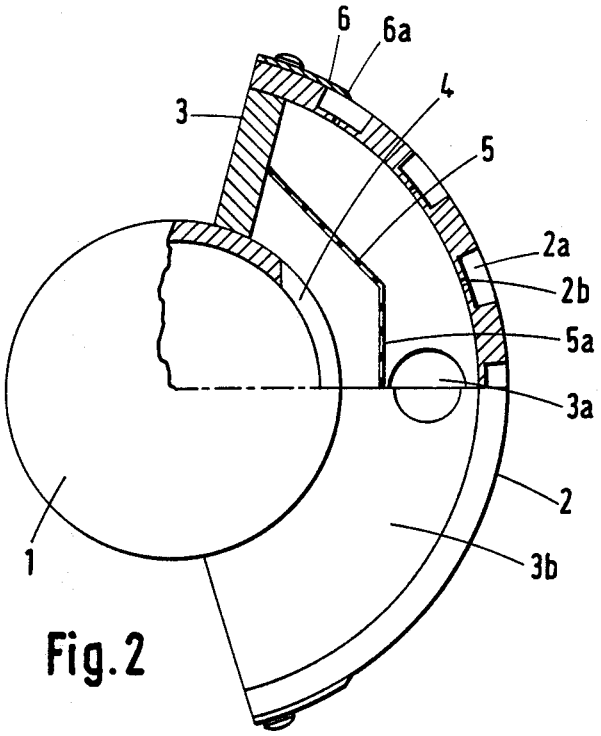
FIG. 2 is a cross-section taken on the line II—II of FIG. 1.

Referring to the drawings, FIGS. 1 and 2 show a contactless web support guide known as an air turn. The air turn has a tubular air supply manifold 1, and an arcuate support face 2 supported on the manifold by a body 3. In use, the air turn is supported by a pair of handles 3*a* provided at the ends of the body 3. A cut-out 4 formed in the manifold 1 permits air to pass from the manifold to the support face 2. The body 3 defines a plenum chamber 3*b* between the manifold 1 and the support face 2. The plenum chamber 3*b* helps to equalize air pressure along the length of the support guide. The support face 2 has a length of about 3 feet and a radius of about 6 inches The arcuate support face 2 extends over an arc which is sufficiently long to guide a web passing thereover through a substantially 90° turn. An air spreader baffle 5 is fixed to the body 3 within the plenum chamber 3*b* in the air flow path from the cut-out 4 to the support face 2. The baffle 5 helps to even out the air pressure along the air turn device, having a large number of circular apertures 5*a* of ½ inch diameter.

The support face 2 is provided with rows of circular pockets 2*a*, each having a diameter of 1 inch and a depth of ⅜ inch. The pockets 2*a* are distributed to substantially fill the face 2. The pockets 2*a* are supplied with air via inlet apertures of holes 2*b*. The inlet holes 2*b* adjacent to the longitudinal edges of the support face 2 have a diameter of ¼ inch, the inlet holes at the centre have a diameter of 1/16 inch, and the remaining inlet holes have diameters graded from 1/16 inch at the centre to ¼ inch at the edges of the support face.

A adjustable slat 6 is provided at each of the longitudinal edges of the support face 2 and is mounted for example, with screws for adjustment relative to the face 2. Each slat 6 overlies the pockets 2*a* of the row of pockets adjacent to that edge. Each slat 6 has a sloping leading edge 6*a*.

In use, pressurised air is supplied to the manifold 1. This air passes through the apertures 5*a* in the baffle 5, and out over the support face 2 via the holes 2*b* and the pockets 2*a*. The air emerging from the pockets 2*a* forms a pressurised cushion between the support face 2 and a web of material (not shown) which is supported and guided by the air turn. The pressurised air is supplied to the manifold 1 by an impeller (not shown) which is controlled by an orthodox controllor (not shown) whose output is dependent upon the web tension. Thus, the pressure of the air cushion at the support face 2 is dependent upon the web tension.

This air turn overcomes the two problems referred to above. Thus, the provision of the rows of circular pockets 2*a* results in an even and low pressure cushion over the support face 2, whilst maintaining lateral web stability. This is because the pressurised air emerging from the pockets 2*a* tends to stabilise the web, probably by establishing a static pressure pattern over the support face 2, which prevents the web moving laterally. The grading of the holes 2*b* from the centre of the support face 2 towards the two longitudinal edges helps to give an even layer of air over the support face. This grading also results in a larger air pressure at the two longitudinal edges than elsewhere on the support face 2, and so helps to ensure sufficient air pressure at the web entry and exit regions of the support face. The provision of the slats 6 also helps to ensure the maintenance of air pressure at these entry and exit regions, the slats creating a local increase in pressure (see FIG. 3 which shows the exit region of the air turn, and how the pressure build-up —indicated by the small arrows —pushes the web W away from the support face 2). The adjustability of the slats 6 permits adjustment of the pressure of the air cushion at the longitudinal edges of the support face 2. At the same time, the sloping edges 6*a* of the slats 6 divert the air flow obliquely away from the support face 2, thereby pushing the web away from the support face at the entry and exit regions.

Apart from overcoming the usual two problems, this air turn also has the advantage of being relatively silent when compared with known air turn devices which rely on jets of air at the entry and exit regions.

Figure 3:
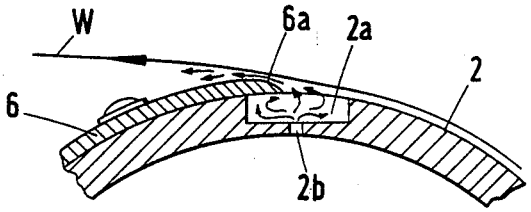
FIG. 3 is an enlarged view of part of the guide shown in FIG. 2.
Figure 4:
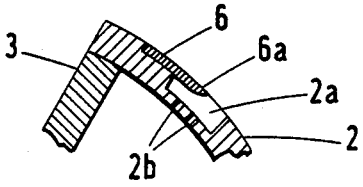
FIG. 4 is a view, similar to that of FIG. 3, of a modification of the first form of guide.

FIG. 4 shows a modified arrangement which results in an increase in the air pressure at the two longitudinal edges of the support face 2. This improvement is achieved by positioning the slats 6 so as to project into the adjacent pockets 2*a* (rather than overlying them as in the case with the embodiment shown in FIGS. 1 to 3), and by providing each of these pockets with two or more holes 2*b*. This results in an increase in the air pressure in the pockets 2*a* adjacent to the longitudinal edges of the support face 2.

Figure 5:
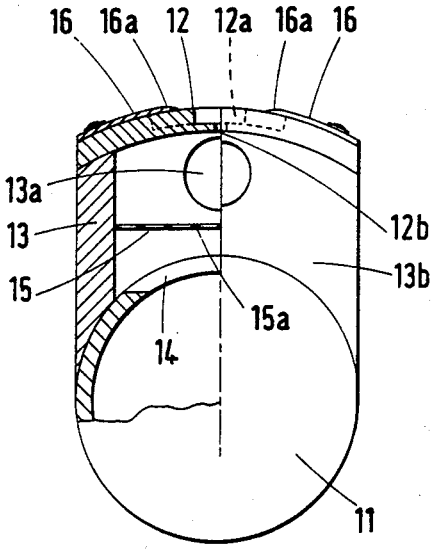
FIG. 5 is a transverse cross-section through the second form of contactless support guide.

FIG. 5 shows a second form of contactless web support guide. This support guide (air bar) is intended to support and guide a web travelling generally in a rectilinear manner. Thus, this support guide has an arcuate support face 12 which is curved only slightly. In other respects, this support guide is similar to the air turn shown in FIGS. 1 and 2, in that it has a supply manifold 11, a body 13 having a pair of handles 13*a*, a plenum chamber 13*b*, cut-out 14, an air spreader baffle 15 having apertures 15*a* and holes 15*b*, and a pair of adjustable slats 16 having inclined leading edges 16*a*. As with the embodiment of FIGS. 1 and 2, the pockets 12*a* are arranged in rows (in this case three rows), the holes 12*b* in the centre having a diameter of 1/16 inch and the holes 12*b* in the two outer rows having a diameter of ¼ inch.

Figure 7:
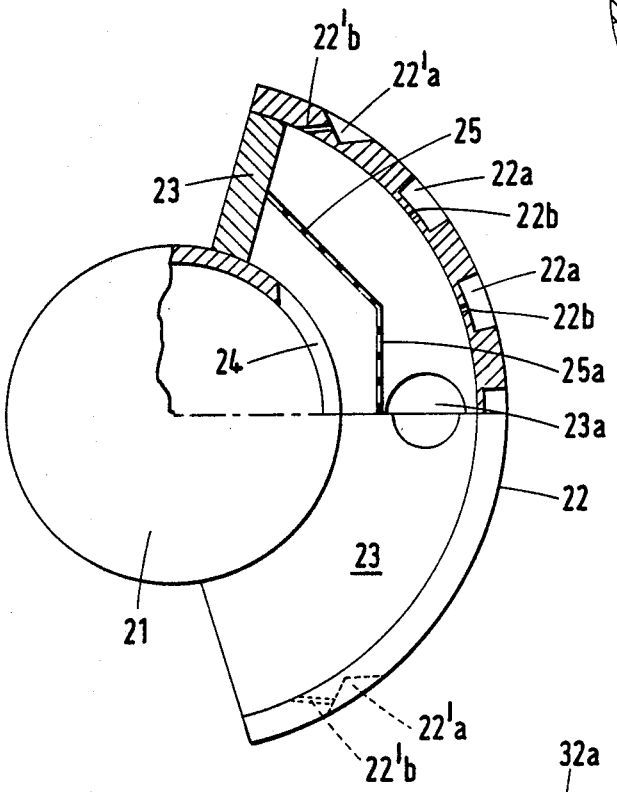
FIG. 7 is a cross-section taken on the line VII—VII of FIG. 6.
Figure 6:
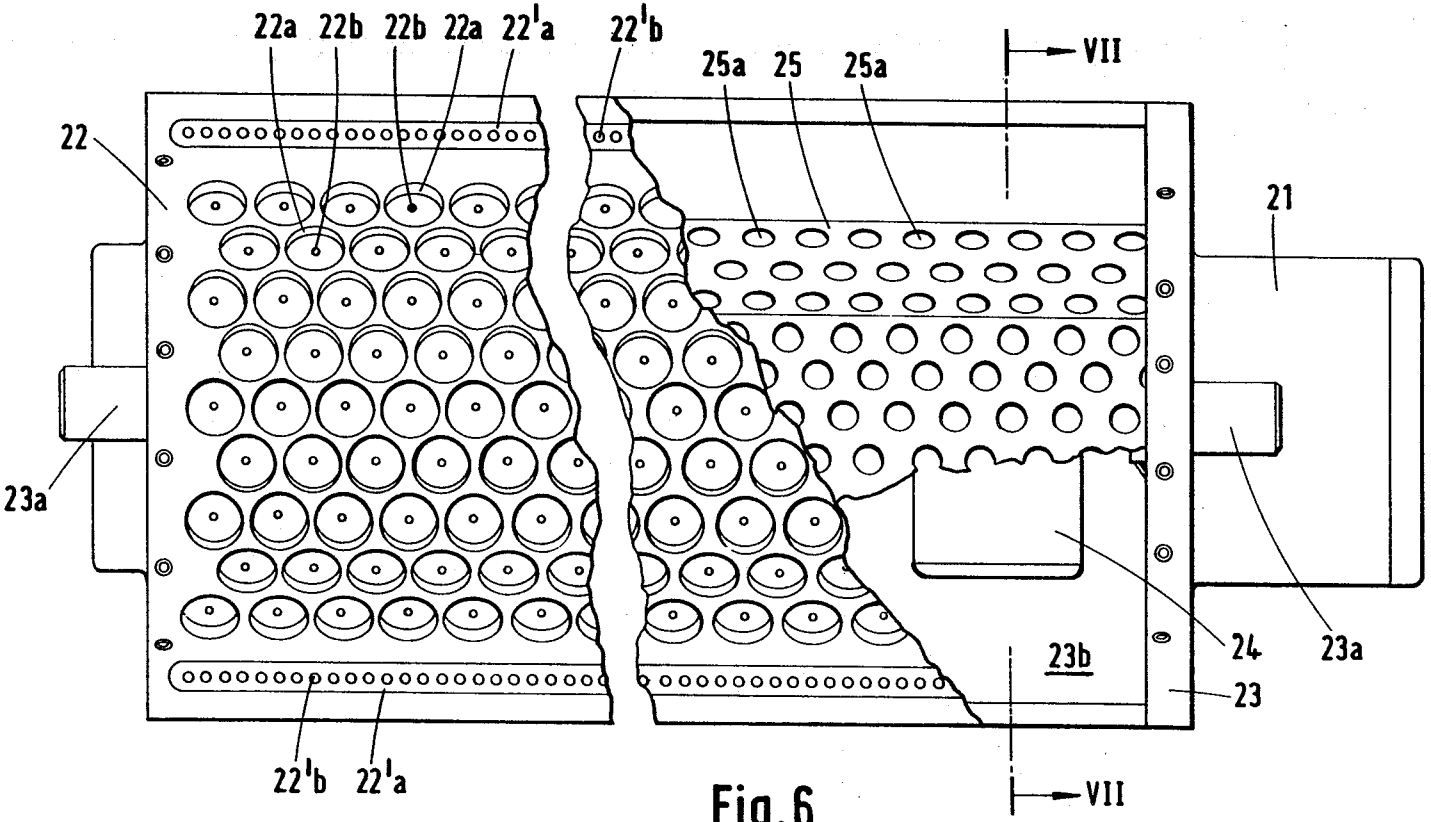
FIG. 6 is a side elevation, partially broken away, of the third form of contactless support guide.

FIGS. 6 and 7 shows a third form of contactless web support guide which is a modification of that shown in FIGS. 1 to 3 but in which the slats 6 are omitted. This guide or air turn has a tubular air supply manifold 21, and an arcuate support face 22 supported on the manifold by a body 23. In use, the air turn is supported by a pair of handles 23*a* provided at the ends of the body 23. A cut-out 24 formed in the manifold 21 permits air to pass from the manifold to the support face 22. The body 23 defines a plenum chamber 23*b* between the manifold 21 and the support face 22. The support face 22 has a length of about 3 feet and a radius of about 6 inches. The arcuate support face 22 extends over an arc which is sufficiently long to guide a web passing thereover through a substantially 90° turn. An air spreader baffle 25 is fixed to the body 23 in the air flow path from the cut-out 24 to the support face 22. The baffle 25 helps to even out the air pressure along the air turn device, having a large number of circular apertures 25*a* of ½ inch diameter.

The support face 22 is provided with rows of circular pockets 22*a*, each having a diameter of 1 inch and a depth of ⅜ inch. The pockets 22*a* substantially fill the face 22 and are supplied with air via inlet apertures or holes 22*b*. The inlet holes 22*b* have a diameter of ⅛ inch. Adjacent to each longitudinal edge, the support face 22 is provided with an elongate pocket 22'*a*, each of which has a width of ⅜ inch and a maximum depth of ⅜ inch. The pockets 22'*a* are supplied with pressurised air via inlet holes 22'*b* which have a larger diameter of 3/16 inch and which are spaced apart by ¼ inch. The pockets 22'*a* and the inlet holes 22'*b* adjacent to the longitudinal edges of the support faces 22 of this air turn are angled towards the centre of the support face.

In use, pressurised air is supplied to the manifold 21. This air passes through the apertures 25*a* in the baffle 25, and out over the support face 22 via the holes 22*b*, 22'*b* and the pockets 22*a*, 22'*a*. The air emerging from the pockets 22*a*, 22'*a* forms a pressurised cushion between the support faces 22 and a web of material (not shown) which is supported and guided by the air turn. The pressurised air is supplied to the manifold 21 by an impeller (not shown) which is controlled by an orthodox controller (not shown) whose output is dependent upon the web tension. Thus, the pressure of air cushion at the support face 22 is dependent upon the web tension.

The pockets 22'*a* produces zones of somewhat higher pressure in the cushion at the marginal regions where the web enters and exits the guide. The provision of the rows of circular pockets 22*a* results in an even pressure cushion over the majority of the support face 22, whilst the higher pressure zones maintain lateral web stability. The provision of the angled pockets 22'*a* and inlet holes 22'*b* at the longitudinal edges of the support face 22 also helps to ensure the maintenance of air pressure at these entry and exit regions, and also diverts the air flow obliquely away from the support face 22, thereby pushing the web away from the support face at the entry and exit regions.

As with the air turn of FIGS. 1 to 3, this air turn also has the advantage of being relatively silent when compared with known air turn devices which rely on jets of air at the entry and exit regions.

The air turn of FIGS. 6 and 7 can work with much higher web tensions than those of FIGS. 1 to 4, and so is the preferred embodiment of the invention. Moreover, because of the increase in stability which results from the inclined pockets 22'*a* and holes 22'*b*, it is possible to dispense with the direct supply of pressurised air to the circular pockets 22*a*, that is to say the inlet holes 22*b* can be dispensed with. In this case, the pockets 22*a* are supplied with pressurised air indirectly—via the pockets 22'*a* and the web of material. Thus it is possible to make at least some or all of the pockets 22 blind so that all the air emitted by the holes 22'*b* in the elongate pockets 22'*a*.

Figure 8:
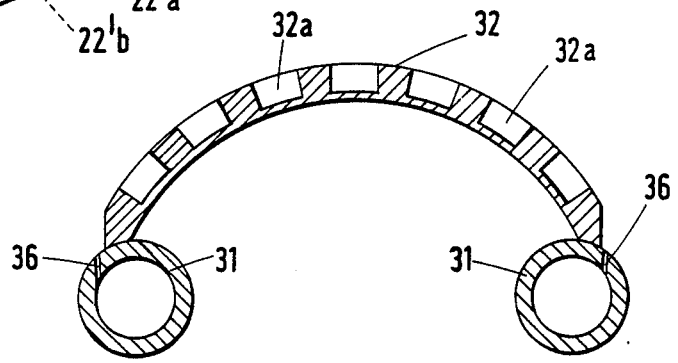
FIG. 8 is a transverse cross-section taken through the fourth form of contactless support guide.

FIG. 8 shows a further form of contactless web support guide whose circular pockets are not directly supplied with pressurised air. Thus, FIG. 8 shows an air turn having a pair of tubular air supply tubes 31, and an arcuate support face 32 whose longitudinal edges are fixed to the air supply tubes. Each of the tubes 31 has an external diameter of 3 inches, an internal diameter of 2 ½ inches, and is provided with a plurality of holes 36 extending along that tube in line with the adjacent longitudinal edge of the support face 32. The holes have a diameter of 3/16 inch, a spacing of ¼ inch, and are positioned to direct air flow from the tube interior to towards the adjacent longitudinal edge of the support face 32. The support face 32 has a length of about 3 feet and a radius of about 6 inches. The support face 32 is provided with rows of circular pockets 32*a*, each having a diameter of 1 inch and a depth of ⅜ inch. The pockets 32*a* are distributed in a similar manner to the pockets 2*a* of the embodiment of FIG. 1.

In use, pressurised air is supplied to the tubes 31 via inlets (not shown) formed in their central regions. This pressurised air emerges from the holes 36 and forms a pressurised air cushion behind a web (not shown) of material passing over the support face 32. The web itself is instrumental in directing the air flow over the support face 32 and into the pockets 32*a*. Once again, this air turn overcomes the problems referred to above. In particular, the pressurised air in the pockets 32*a* results in an even and low pressure cushion over the support face 32, whilst maintaining lateral web stability. This lateral stability is enhanced by the longitudinal riding which results from the air flow through the holes 36.

It will be apparent that the contactless web support guides described above could be modified in a number of ways. For example, the grading of the inlet holes 2*b* of the embodiments of FIGS. 1 to 4 is not essential, so all these inlet holes could have the same diameter. Moreover, lateral stability can also be achieved by lifting the centre of the web slightly (for example by about ⅛ inch), so that the web is curved slightly from edge to edge. This can be accomplished either by curving the support face from edge to edge, or by increasing the air pressure in the central region of the web.

Figure 9:
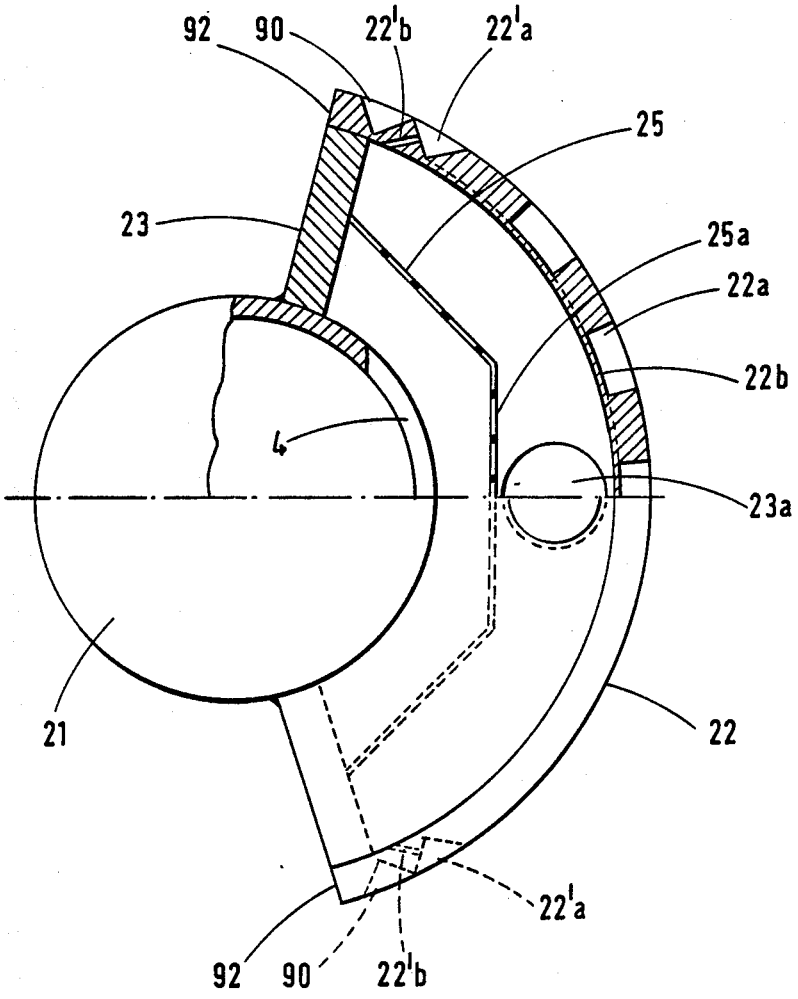
FIG. 9 is a cross-section of a further form of contactless support guide.

The guide shown in FIG. 9 is similar to that shown in FIGS. 6 and 7 and uses like reference numerals. The guide differs from the construction of FIGS. 6 and 7 in having an additional elongate pocket 90 or an elongate group of pockets nearer each extreme end 92 of the surface 22 and adjacent the elongate pockets 22'*a*. Unlike the latter, the additional pockets 90 are blind and do not receive pressurised air from the manifold 21. These extra pockets 90 improve the operational characteristics of the guide by creating static air pads at the extreme exit and entry regions. These pads appear to reduce noise, increase stability and make angular setting of the web less critical.

We Claim

1. A contactless support guide for guiding a moving web of material; said guide comprising means defining an arcuate support face for controlling the moving web; a multiplicity of first pockets in the support face, the first pockets being distributed over the support face to substantially fill the face; apertures in said first pockets for emitting air; further elongate pockets provided in the support face at marginal regions where the web enters and exits the guide; a plurality of closely spaced apertures in each of the further pockets for emitting air; and air supply means, including a manifold, for receiving pressurized air and for supplying said air to the apertures of the first and further pockets to create an air cushion extending around the support face to support the moving web in a generally uniform spaced relationship relative to the support face; wherein the further pockets are angled towards the first pockets and the apertures in the further pockets are larger than the apertures in the first pockets to produce zones of higher pressure in the air cushion at said marginal regions where the web enters and exits the guide.

2. A contactless support guide for guiding a moving web of material; said guide comprising means defining an arcuate support face for controlling the moving web; a multiplicity of first pockets in the support face, the first pockets being distributed over the support face to substantially fill the face; further elongate pockets provided in the support face at marginal regions where the web enters and exits the guide; a plurality of closely spaced apertures in each of the further pockets for emitting air; and air supply means, including a manifold, for receiving pressurized air and for supplying said air to the apertures of the further pockets to create an air cushion extending around the support face to support the moving web in a generally uniform spaced relationship relative to the support face; wherein the further pockets and the apertures therein are angled towards the first pockets and zones of higher pressure are produced in the air cushion at said marginal regions where the web enters and exits the guide.

3. A contactless support guide for guiding a moving web of material; said guide comprising means defining an arcuate support face for controlling the moving web; a multiplicity of first pockets in the support face, the first pockets being distributed over the support face to substantially fill the face; second elongate pockets or groups of pockets provided the support face at marginal regions where the web enters and exits the guide; a plurality of closely spaced apertures in each of the second pockets for emitting air; at least one further blind pocket disposed between one of the second pockets or groups of pockets and an adjacent edge of the support face and air supply means, including a manifold, for receiving pressurized air and for supplying said air to the apertures in the second pockets to create an air cushion extending around the support face to support the moving web in a generally uniform spaced relationship relative to the support face; wherein the second pockets and apertures therein are angled towards the first pockets.

4. A support guide according to claim 3, wherein a number of further blind pockets are provided between the edges of the support face and the elongate pockets.

5. A support guide according to claim 4, wherein the further blind pockets are also elongate.

6. A support guide according to claim 4, wherein apertures are provided in at least some of the first pockets for emitting air.

7. A support guide according to claim 6, wherein the apertures in the first pockets are smaller than the apertures in the second pockets.

8. A support guide according to claim 3, wherein the second pockets and said at least one further pocket lie parallel to one another.

9. A contactless support guide for guiding a moving web of material, said guide comprising an arcuate support face for controlling the moving web; a multiplicity of pockets in the support face which are distributed over the support face to substantially fill the face; apertures in at least some of the pockets for emitting air to create an air cushion extending around the support face to support the moving web in a generally uniform spaced relationship relative to the support face; air supply means, including a manifold, for receiving pressurized air and for supplying said air to said apertures and slats positioned at end regions of the support face where the web enters and exits the guide, the slats being disposed relative to the support face to control the air flow and the cushion to increase the tendency of the latter to lift the web away from the support face at the web entry and exit regions.

* * * * *